US007316088B1

(12) United States Patent
Lewis

(10) Patent No.: US 7,316,088 B1
(45) Date of Patent: Jan. 8, 2008

(54) VEHICLE LOCATOR CARD

(75) Inventor: Mark W. Lewis, Greenville, SC (US)

(73) Assignee: Marjen, Inc., Greenville, SC (US)

( * ) Notice: Subject to any disclaimer, the term of this patent is extended or adjusted under 35 U.S.C. 154(b) by 0 days.

(21) Appl. No.: 11/448,203

(22) Filed: Jun. 7, 2006

(51) Int. Cl.
*A44B 15/00* (2006.01)

(52) U.S. Cl. ..... 40/634; 40/673; 40/674; 40/665

(58) Field of Classification Search ..... 40/674, 40/6, 673, 299.01, 665, 634; 283/61, 62
See application file for complete search history.

(56) References Cited

U.S. PATENT DOCUMENTS

| | | | | |
|---|---|---|---|---|
| 1,749,399 | A * | 3/1930 | Thayer | 40/634 |
| 2,578,548 | A * | 12/1951 | Histed | 40/665 |
| 4,846,501 | A | 7/1989 | Del Grande | 282/9 R |
| 4,907,359 | A | 3/1990 | Berman | 40/299 |
| 5,104,148 | A * | 4/1992 | Neal | 283/81 |
| 5,560,657 | A * | 10/1996 | Morgan | 283/80 |
| 5,782,497 | A | 7/1998 | Casagrande | 283/110 |
| 6,250,556 | B1 * | 6/2001 | Schneider | 235/487 |
| 6,352,287 | B2 | 3/2002 | Casagrande | 283/81 |
| 6,352,608 | B1 | 3/2002 | Garden | 156/249 |
| 2003/0106250 | A1 * | 6/2003 | Best et al. | 40/674 |
| 2004/0026916 | A1 * | 2/2004 | Thompson et al. | 283/61 |
| 2004/0084536 | A1 * | 5/2004 | Goade, Sr. | 235/488 |
| 2005/0236832 | A1 * | 10/2005 | Best et al. | 283/74 |
| 2006/0163868 | A1 * | 7/2006 | Baumann | 283/66.1 |

* cited by examiner

*Primary Examiner*—Gary C. Hoge
(74) *Attorney, Agent, or Firm*—Charles L. Schwab; Nexsen Pruet, LLC

(57) ABSTRACT

A vehicle identification and locator card for vehicle parking and servicing establishments includes three segments which can be detached from one another. All three carry the same vehicle identification number. A first segment is placed in the vehicle, a second segment is given to the customer and the third segment includes a die cut removable spatula shaped key tag carrying the vehicle identification number which can be attached to the vehicle key and hung on the hook or peg pending use by the service personnel or return of the vehicle owner. The key tag includes a rubber based adhesive backing and includes a handle portion which is passed through the key ring or hole in the ignition key and then sandwiched between folded parts of a paddle portion of the spatula. The folding brings into registration two holes punched in the paddle portion thereby facilitating hanging the key tag on a hook or peg.

4 Claims, 3 Drawing Sheets

VEHICLE LOCATOR CARD

RELATED APPLICATION

Related pending United States patent application include Ser. No. 10/860,459 filed Jun. 3, 2004 for a Vehicle Locator and Identification Card; Ser. No. 11/007,509 filed Dec. 8, 2004 for a Vehicle Locator and Identification Card; Ser. No. 11,076,351 filed Mar. 9, 2005 for a Service Hang Tag and Ser. No. 11/342,791 filed Jan. 30, 2006 for a Vehicle Identification Card.

BACKGROUND OF THE INVENTION

Business concerned with parking or servicing vehicles have a problem of correlating the ignition key and the vehicle owner with a particular vehicle. Paper cards with three segments separated by perforations and carrying the same number have been provided so that one segment serves as a claim check, a second segment is placed in the vehicle and a third segment has a key ring stapled to it. A computer type multiple copy form with perforated tear-off strips has been proposed for correlation of ignition key, vehicle and customer which includes perforation lines permitting separation of the form into sections—one to be placed on the vehicle, one to be connected to the ignition key in some undisclosed manner and one to be given to the automobile owner as a claim check. It has been found that in inclement weather, the paper vehicle key tag can become wet; causing it to lose strength, thereby increasing the risk of it breaking and a consequential loss of the key.

BRIEF DESCRIPTION OF THE INVENTION

A three segment vehicle locator and key tag card made of a thin paperboard is perforated or slotted to form three detachable segments all carrying the same locator number, namely an upper segment adapted to be placed in the vehicle, a first lower segment serving as a customer claim ticket and a second lower segment in which a vehicle key tag is formed. A patch of synthetic paper has a silicon coated patch bonded to the back side of the second lower segment by a nondrying adhesive and the front side of the second lower segment is covered by a transparent MYLAR laminate. A spatula shaped key tag is formed in the second lower segment by a die cut through the MYLAR laminate and the paperboard card. The spatula shaped key tag has a narrow handle part attached to a much wider blade part. The blade is perforated across its midsection through the MYLAR laminate and the paperboard on a line at right angles to the direction of elongation of the handle and a pair of holes are punched in the paperboard blade at opposite sides of and at equally distances from the line of perforations. When the key tag is removed from the patch, the free end of the handle may be placed through the usual hole in the ignition key or though a ring commonly attached to the ignition key and then the free end of the handle is folded over onto the adhesive side of the blade. The blade is then folded at its line of perforations bringing the two holes in alignment and adhering the folded parts of the blade together with the end of the handle adhesively bonded therebetween.

BRIEF DESCRIPTION OF THE DRAWINGS

The invention is illustrated in the accompanying drawings, in which:

FIG. 2 a partial perspective view of the vehicle locator card showing the key tag partially removed there from;

As shown in FIG. 1, the vehicle locator card 11 includes a rectangular shaped sheet 12 which has been perforated on a horizontal line 13 and a vertical line 14 to form an upper segment 16 a first lower segment 17 and a second lower segment 18. The same vehicle locator number is printed on all three segments. The upper segment 16 includes an annular hole 21 and a slot 22 extending form the hole 21 to the top of the upper segment 16. The upper segment is placed in the vehicle. The first lower segment 17 is the customer's claim check and the second lower segment 18 contains a removable vehicle key tag 26. A clear plastic or MYLAR re-enforcing patch 27 is adhered to the front side of the second lower segment 18 covering the vehicle key tag 26.

Figure 2:
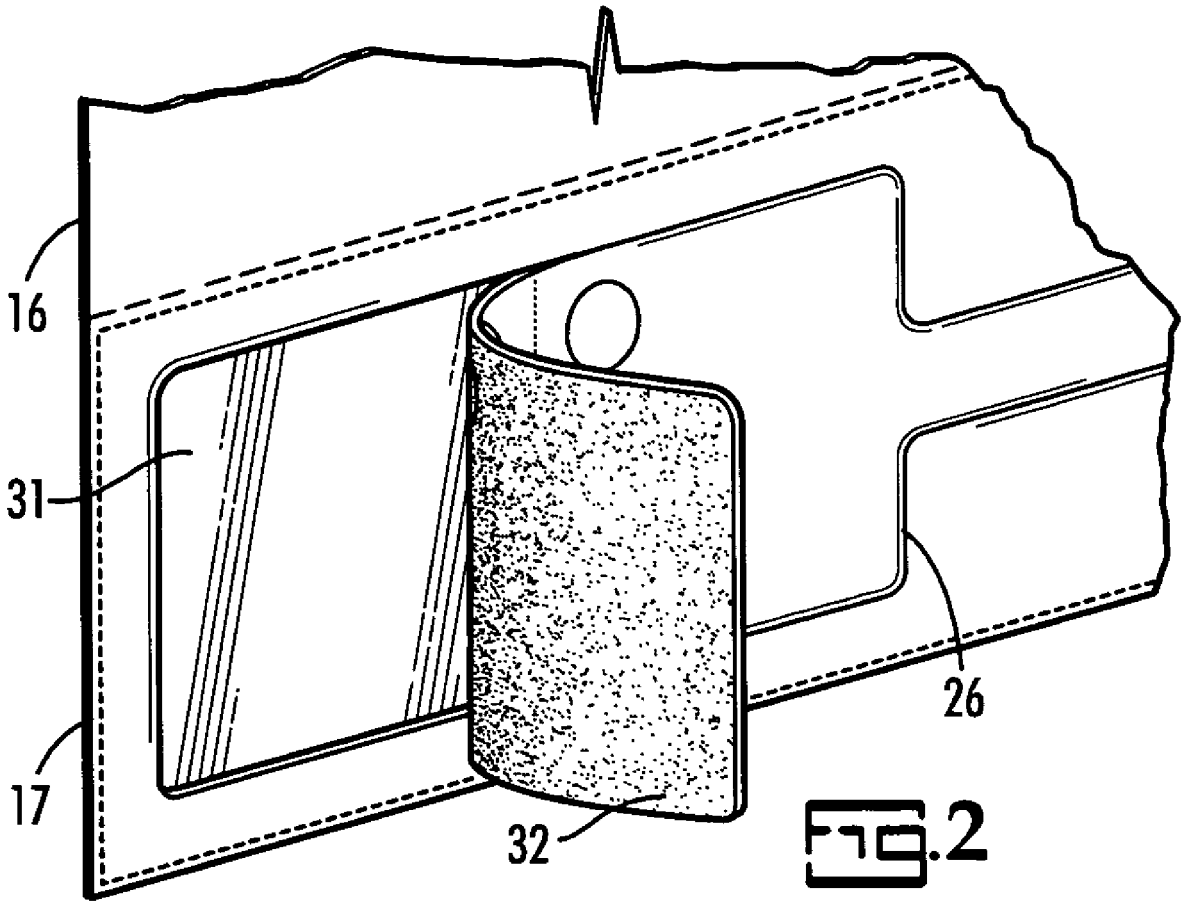
Figures 3, 4:
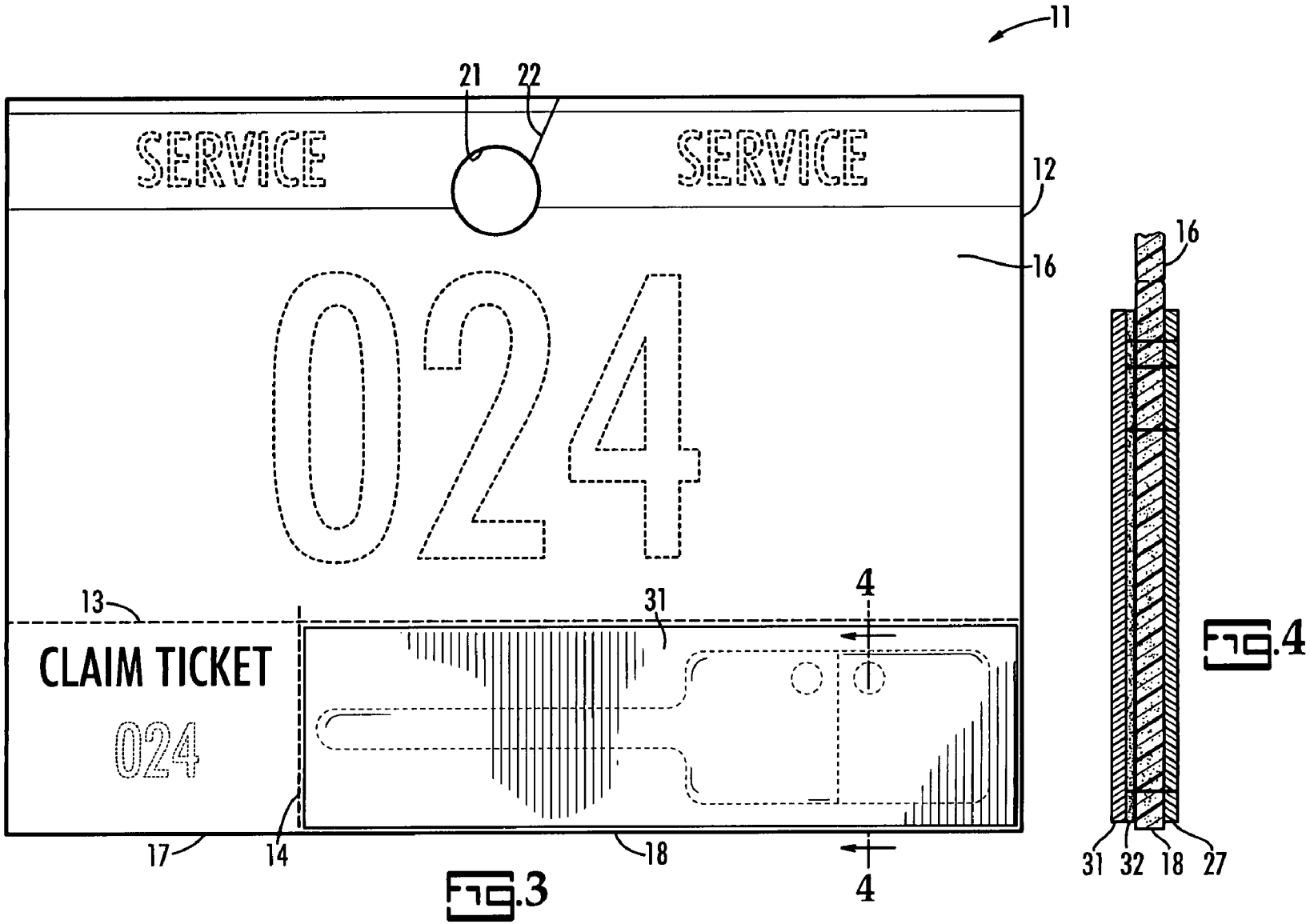
FIG. 3 is a rear view of the vehicle locator card.
FIG. 4 is a section taken on the line 5-5 in FIG. 3.

Referring also to FIGS. 2, 3 and 4, a silicon coated patch 31 is secured to the rear side of the second lower segment 18 by a rubber based adhesive 32. The side of the silicon coated path 31 adhered to the back side of the second lower segment 18 is very smooth, whereas the back side of the card 12 is relatively rough by comparison. Thus the rubber cement or adhesive has greater adhesion to the card material than the smooth surface of the patch 31. The outline or the spatula shaped key tag 26 is die cut through the reinforcing patch 27, the sheet 16 and rubber cement 32 and a pair of holes 41, 42 are punched in the paddle 36 of the key tag 26. The holes 41, 42 are equally spaced from a line of perforations 43 punched transversely across the midsection of the elongated paddle 36 transverse to the longitudinal direction of of the elongated handle 41' of the spatula shaped key tag 26. The holes 41, 42 are aligned in the direction of elongation of the paddle 36 and their longitudinal alignment is laterally offset from the narrow handle 41'.

Figure 1:
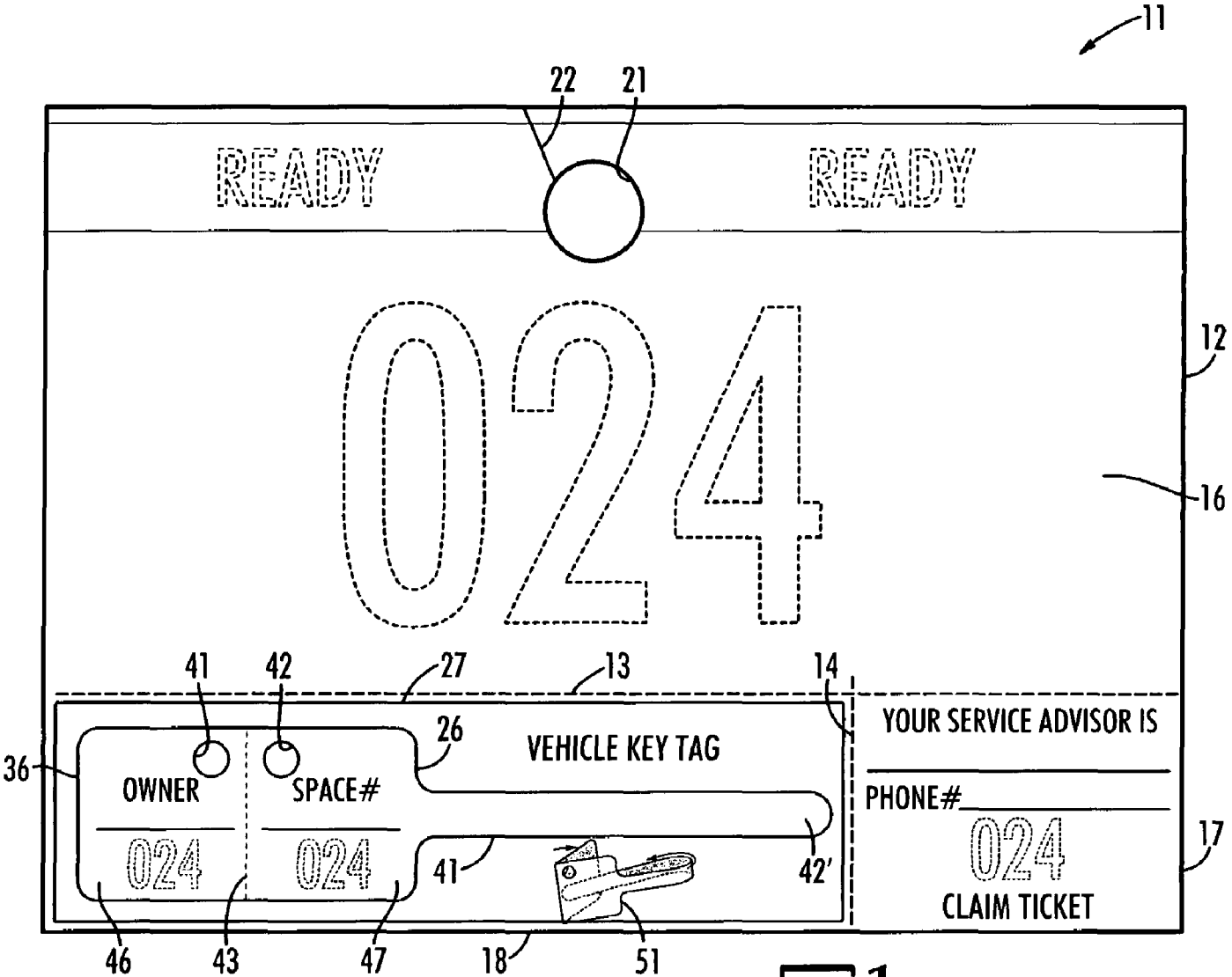
FIG. 1 is a front view of the vehicle locator card.

When the key tag 26 is removed from the card 11 the rubber cement remains on its back side, as is illustrated in FIG. 2. After removal of the key tag 26, the distal or free end 42' of the handle 41' is passed through a hole in an ignition key or key ring and adhered or affixed between the half portions 46, 47 of the paddle 36. In making the aforementioned connection, the paddle 36 is folded on the line of perforation 43 as illustrated in the pictorial 51 shown in FIG. 1. The holes 41, 42 are brought into registration when the paddle 36 is folded and the opening formed by the registered holes 41, 42 is not blocked by the handle 41' adhered between the folded segments of the paddle 36 because of their being laterally offset in relation to the narrow handle 41'. When the disks are removed from the holes 41, 42 the key tag 26 can be hung on a peg or nail. The non-drying rubber cement firmly holds the end portion 42' of the handle 41' between the folded halves 46, 47 of the paddle 36.

What is claimed is:

1. A vehicle locator card comprising:

a sheet of thin paperboard having a first line of perforations defining an upper segment and at least one lower segment, said one lower segment having a front side and a rear side, a first patch of thin clear reinforcing plastic adhesively secured to said front side of said one lower segment, a second patch having a smooth side secured by a rubber based adhesive to said rear side of said one lower segment, a spatula shaped key tag die cut through said first patch and said one lower segment forming a key tag with an elongated narrow handle with a distal end and an elongated paddle with a pair of round holes on opposite sides of and spaced a small equal distance from the longitudinal center of said paddle, said holes being out of alignment with said handle, and a second line of perforations in said first patch across said paddle at said longitudinal center of said paddle, said second line of perforations passing between said round holes, said holes being brought into registration when said paddle is folded on said second line of perforations.

2. The vehicle locator card of claim 1 wherein upon removal of said key tag from said one lower segment and placement of said distal end of said handle between portions of said paddle folded over at said second line of perforations, said distal end is securely held to said paddle by said rubber based adhesive adhered to said key tag and said holes are aligned with one another.

3. The vehicle locator card of claim 2 including a third line of perforations defining a second lower segment is side by side relation to said one lower segment, said second lower segment serving as a customer's claim check.

4. The vehicle locator card of claim 2 wherein said handle does not obstruct said aligned holes when said paddle is folded over at said second line of perforations.

* * * * *